United States Patent [19]

Döring

[11] 4,122,795

[45] Oct. 31, 1978

[54] ELASTIC STREET DELINEATOR

[76] Inventor: Erich Döring, Langer Weg 3, 8052 Moosburg, Fed. Rep. of Germany

[21] Appl. No.: 733,004

[22] Filed: Oct. 15, 1976

[30] Foreign Application Priority Data

Oct. 16, 1975 [DE] Fed. Rep. of Germany ..... 2546427

[51] Int. Cl.[2] ..... E01F 9/04

[52] U.S. Cl. ..... 116/63 R; 256/1; 404/10

[58] Field of Search ..... 116/63 R, 63 P; 40/125 H, 125 N, 145 A; 52/155, 730; 256/13.1, 1; 404/10, 9, 11

[56] References Cited

U.S. PATENT DOCUMENTS

| | | | |
|---|---|---|---|
| 1,903,869 | 4/1933 | Meister et al. | 40/145 A |
| 1,931,174 | 10/1933 | Withers | 404/10 |
| 2,802,443 | 8/1957 | Hanson | 116/63 P |
| 2,834,133 | 5/1958 | Carmace | 40/125 N |
| 2,864,331 | 12/1958 | Brands | 116/63 P |
| 2,926,442 | 3/1960 | Reimel | 40/125 H |
| 3,091,997 | 6/1963 | Byrd | 116/63 P |
| 3,340,779 | 9/1967 | Mahoney | 404/10 |
| 3,442,247 | 5/1969 | Osterberg | 116/63 P |
| 3,475,009 | 10/1969 | Brown | 116/63 P X |
| 3,623,286 | 11/1971 | Parduhn | 404/10 X |
| 3,709,112 | 1/1973 | Ebinger | 256/13.1 X |
| 3,820,906 | 6/1974 | Katt | 404/10 X |
| 3,850,536 | 11/1974 | Kone | 404/11 |
| 3,911,854 | 10/1975 | Manuel | 116/63 P |
| 3,934,540 | 1/1976 | Bruner et al. | 116/63 P X |

FOREIGN PATENT DOCUMENTS

| | | | |
|---|---|---|---|
| 2,309,249 | 2/1973 | Fed. Rep. of Germany | 404/10 |

*Primary Examiner*—Daniel M. Yasich

*Attorney, Agent, or Firm*—Burns, Doane, Swecker & Mathis

[57] ABSTRACT

An elastic street delineator or marker is formed by fixing a plurality of rubber strips to a support structure adapted to be anchored in the ground. The rubber sheets comprise tread portions of used automobile tires from which the side walls have been removed.

4 Claims, 13 Drawing Figures

ELASTIC STREET DELINEATOR

Figure 1:
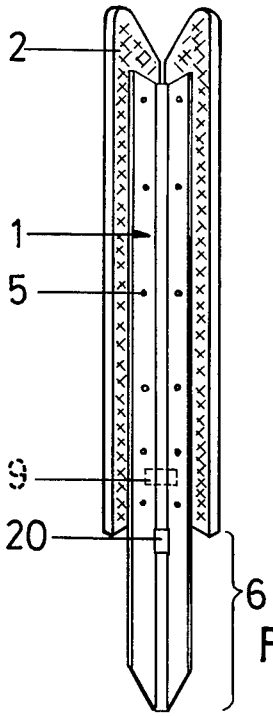

The present invention relates to an elastic street delineator or marker comprising oppositely arranged rubber sheets which are fixed to a support structure and being adapted to be anchored by its lower end in the ground or in a foot inserted in the ground or the like.

Nowadays delineators are no longer made from caoutchouc or rubber (French Pat. No. 1 552 818) because the costs are relatively high when compared with those for posts made from steel and/or plastics, especially glass fiber reinforced cured polyester resin or even wood, considering their durability and lifetime. Moreover, the mechanical expenditure, in particular for the vulcanization required for various shapes and sizes (diameter and length) is great. Rather, the advantages of the natural flexibility of rubber markers or posts are given up, or it is attempted to obtain them by other means. Delineators made from plastics usually have a rated point of failure to reduce the risk of damage to vehicles and drivers in case of a collision. Yet there still remains the risk that delineators are propelled high up against the windshield of passenger cars. And it may happen that also the anchoring is torn out because there is either a catch connection with the fastening foot or another kind of achorage which does not become released quickly enough. Also delineators made of wood are not destructable. The problem of damage with unelastic posts is solved by rendering them bendable so that to a great extent they may be run over by a vehicle. The known delineators are available with different degrees of durability, the most stable ones being the most expensive. As the average lifetime of a delineator along a street is between 2 and 7 years, a compromise between durability and price is aimed at. The risk of damaging or destroying conventional delineators of wood or plastics is particularly great in the winter time and especially so with plastic delineators because they tend to become brittle at low temperatures, and therefore many of them are broken when clearing roads of snow, even if they are not hit.

The risk of destruction is diminished by the suggestion of French Pat. 1 189 250 to design the delineator as a flexible plate provided at its two opposed sides with a protective coating, for instance, of plastic material or a paint coating made with phosphorescent or fluorescent paint. This plate is resiliently secured in the foot which is sunk into the ground. In addition it has a V-shaped recess which ends upwardly in a rounded curve in the direction of the road so that the plate need not bend at the clamping point when it is run over. The recess, moreover, is filled with a caoutchouc mass destined to warrant recovery of the post after being hit or run over.

It is the object of the present invention to provide a delineator of the kind mentioned initially which affords good durability at relatively low cost. It is another object of the invention to provide a delineator which can be produced without the use of expensive special machinery.

To meet these and other objects which will become apparent as the description proceeds it is provided, in accordance with the invention that the elongated rubber sheets fixed to the support structure consist of tread surface parts of old automobile tires from which the sidewalls were removed. The rubber sheets may be provided in per se known manner with paint coatings so as to look like the customary delineators or other posts. Besides, they may be produced at any desired width or length without causing any problem. In a useful embodiment the rubber sheets together with the support structure extend down as far as the lower end of the delineator so that they can either be put directly into ground or into a foot for insertion into ground.

In a preferred embodiment the support structure ends above the lower end or is at least interrupted above the lower end in the area of a rated bend point. In both cases it is possible for the delineator which is otherwise of stable shape to bend at this very point when being run over by a car or the like and to erect itself again afterwards into the original position.

The support structure may consist of at least one support element being approximately V-shaped or trapezoidal in cross section. The two rubber sheets are secured to the legs thereof in V shape at an angle relative to each other.

In the area of the rated bend point the support structure may have an interruption at either side of its central axis. This interruption may be provided in the form of a plurality of recesses, e.g. several punched round openings. Such a delineator is highly stable in shape and yet it may be run over readily by a vehicle without the risk of serious damage either to the vehicle or to its occupants. This delineator, of course, will not erect itself automatically into its original upright position. However, as the support structure is interrupted in the area of the central axis, it is easy to bend this delineator back into position by hand for continued use.

Instead of a V-shaped profile the support structure may comprise two parallel flat rubber strips disposed at a certain spacing from each other and preferably of different widths so that, upon fastening of the two rubber sheets to the inclined front faces of the rubber strips, e.g. by screws or vulcanization, the latter extend in V shape with respect to each other.

Another advantageous embodiment of the delineator according to the invention is obtained if the support structure is formed by a foam body intimately joined with the rubber sheets in a composite structure. If an interruption is provided to act as rated bend point, the foam body preferably consists of hard foam having closed pores.

In a simple and very advantageous embodiment of a delineator acc. to the invention the support structure is formed by a profile rod with round, square or rectangular cross section. The rubber sheets being glued, vulcanized or riveted together along the edges receive, between each other the profile rod by a clamping action. The profile rod extends to the lower end of the rubber sheets but ends off the upper end of it.

Complete erection upon bending of a delineator may be enhanced, with those embodiments having a rated bend point which is realized by an interruption of the support structure, if a rubber disc filling the cross sectional area is secured at either end of such an interruption. The rubber discs which may have a thickness of about 2 cm. are retained by screws or by bonding or clamping between the rubber sheets and the support structure. In the case of V-shaped or trapezoidal support profiles openings may be provided for this purpose in the area of the central edge as well as recesses at the two outer margins. These rubber discs serve to urge the rubber sheets back into the original cross sectional outline upon bending.

Particularly inexpensive and consequently simple manufacture of the delineator according to the invention is rendered possible because old or used car tires are used to make it. This is done by using the tread surface parts of old tires from which the sidewalls were separated as rubber sheets. The remaining ring, upon severing of the sidewalls, which is practically cylindrical, or may at best be slightly crowned, is cut in transverse direction so that a flat band of greater or smaller length, depending on the tire size, is obtained. From this band are cut the rubber sheets and, if desired, rubber strips for the support structure, and rubber discs, all at the desired length or width or in the desired shape. The rubber sheets should be fastened with the tread surface facing the support structure so that the inside surface of the tire will be the visible side of the delineator because this will provide a better outward appearance.

Such a delineator essentially consists of old tire material since relatively little material is required for the support structure or the support element. The smooth inside of the tire is provided with the respective paint coating. These delineators may be given such an appearance that they may be mistaken for the known plastics delineators, at least from a certain distance. The fixing of the old tire rubber sheets to a support reduces their inherent bias to such a degree that the sheets appear to be flat. This is possible only if the tread surface portion is recovered from an old tire, in other words only the central portion, removing the sidewalls. Although the sidewalls, too, could be rendered flat so that plane sections could be obtained from them, this would involve too much expenditure. Such great amounts of old tires are available that even when utilizing only the tread surface portions, especially durable, inexpensive delineators can be produced which have a favorable impact behavior. The exploitation of old tires helps solve a waste problem. The recovery of the tread surface portions requires no special machinery. Ordinary rubber cutting machines or scissors will serve the purpose. The riveting to the sheetlike supports can be done with conventional riveting apparatus and, in general, self-cutting rivets can be used so that prior punching of the supports and rubber sheets may be dispensed with. The caoutchouc with the cord inlay of the old tire is under such tension that great permanent elasticity and stability are warranted. Corrosion of the rubber sheets which are the principal elements exposed to outside influences is negligible. The delineators demand hardly any maintenance. Providing paint coatings is not a problem either.

As compared to known delineators the delineator according to the invention has the advantage of greater durability when being hit and of improved weather resistance. Delineators according to the invention are elastic. The material expenditure accounts for almost nothing because of the old tires which are available in almost unlimited number. They do not become brittle in the winter like the plastics delineators. The provision of the rated bend point permits them to be hit from any side and to bend over almost at right angles, provided rated bend points are located above the fastening area in one form or another. The delineators according to the invention are just as straight after a collision as before. The bending and renewed erection may be repeated a number of times. No changes in shape or quality could be observed.

The supporting or reinforcing profile of the delineator need not be made from metal but may also consist of plastics, wood or even tire portions.

The rubber sheets may be attached to the support by screws, by bonding, clamping or riveting. The rubber sheets may also be connected to each other along their length. If their lengths are connected to each other they may also form a kind of compressed flat hose.

The support structure may be interrupted, to establish the rated bend point, a few centimeters only above ground or, if the delineator is inserted in a foot, a few centimeters above the foot. In the ground or in the foot the support structure may continue. The two rubber sheets fixed laterally to the support afford the resilient bending elements. The delineator may also comprise a plurality of rated bend points. Any rated bend point may be changed as to spring action by weakening the rubber layer or by applying more rubber pieces on top or underneath the same.

If the delineator is to be inserted into a foot, the part which will be inserted is conveniently designed so that it will fill the foot opening so as to prevent earth from falling in. To achieve that it is sufficient for the opening to have the cross sectional shape of the fastening end of the delineator.

If the support structure is made quite a bit longer than the rubber sheets, the delineator can be driven directly into ground. To this end a small hammer impact face is provided at the lower end of the support structure. Then a foot in the ground may be dispensed with. This embodiment also permits the provision of an interruption above the fastening so as to form a rated bend point at that position in the support structure. The light curvature of the tire tread surface is conveniently used as elastic gliding seat at least in the inserting zone of the rubber sheets or side elements of the delineator where it is placed in a retainer e.g. a foot. This elasticity of the slightly curved rubber material not only permits easier introduction of the delineator but also secures it against unsteadiness by virtue of its inherent tension. Moreover, manufacturing tolerance of the fastening opening in the retainer are balanced.

If the delineator is touched by a vehicle or the like, it becomes slightly distorted, thus evading load from outside, because it is provided with the rated bend point in the form of a complete or partial interruption of the support structure. It may not only be hit from any side but even be run over. In that case it will lie flat on the ground and erect itself afterwards, provided the interruption of the support structure is a complete one. The usual indications may be formed or attached by screws or cement to the delineator in generally known manner. Moreover, the visible surfaces may be provided with the usual colors.

Figure 2:
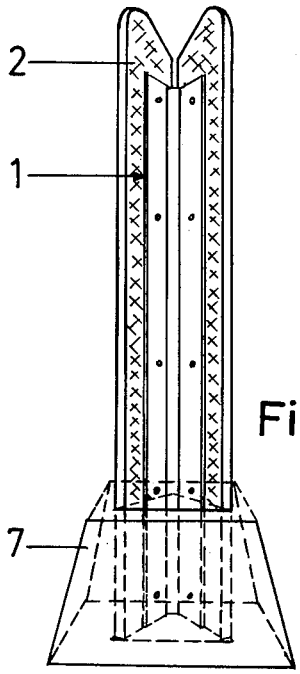
Figure 4:
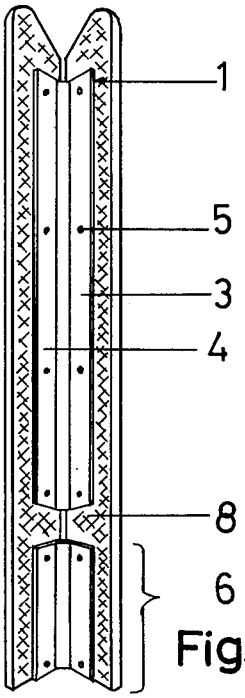
Figure 3:
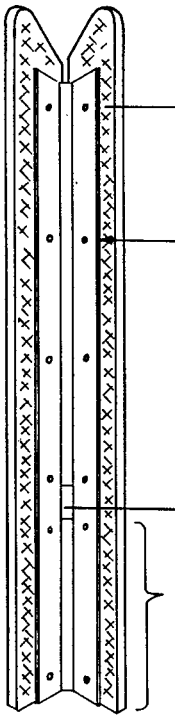
Figure 5:
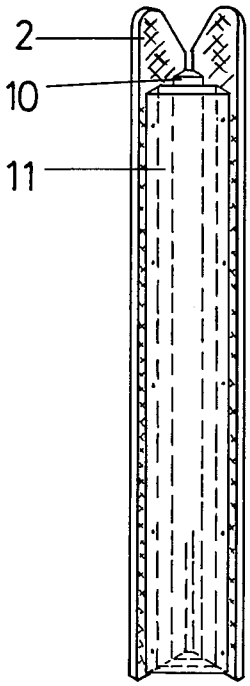
Figure 11:
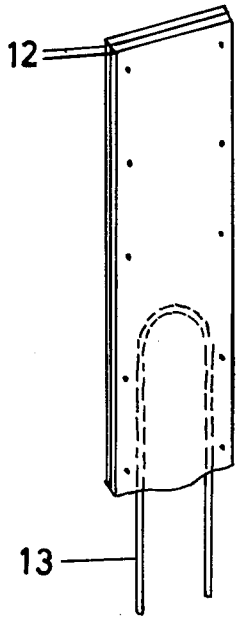
Figure 6:
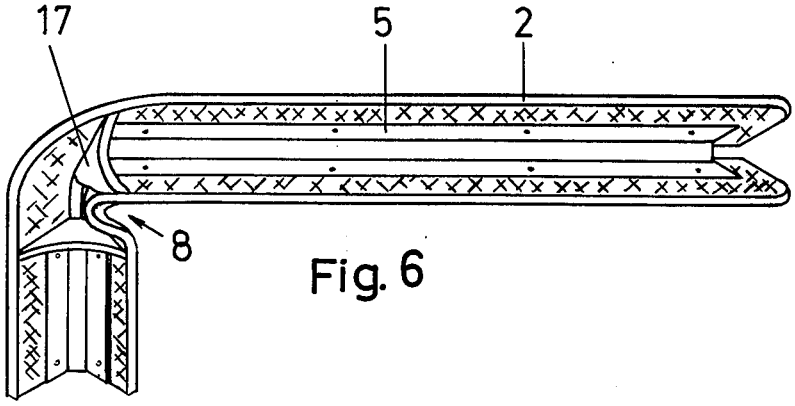
Figure 7:
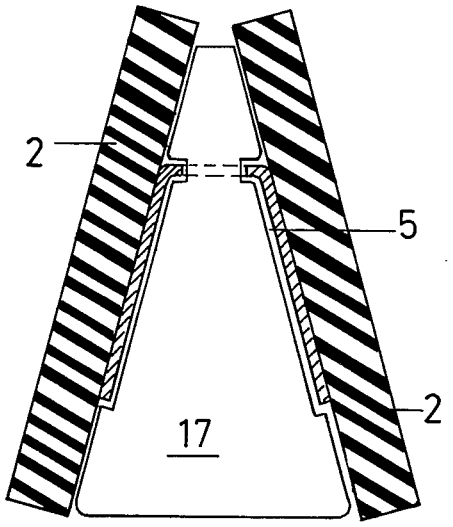
Figure 8:
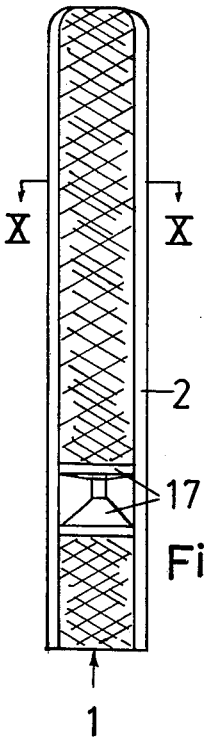
Figure 9:
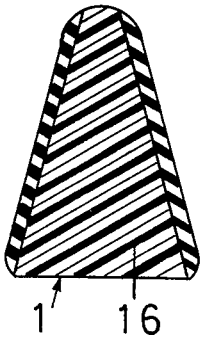
Figure 10:
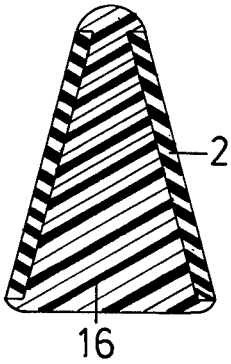
Figure 12:
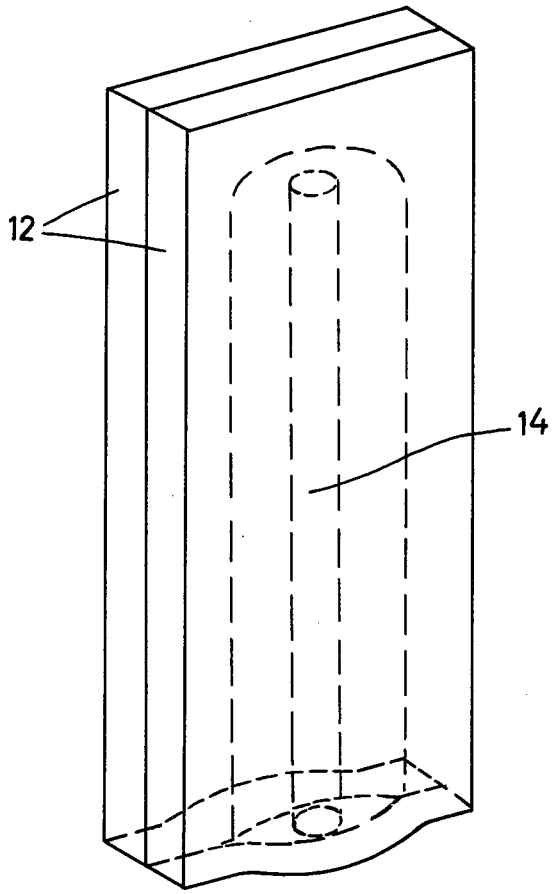
Figure 13:
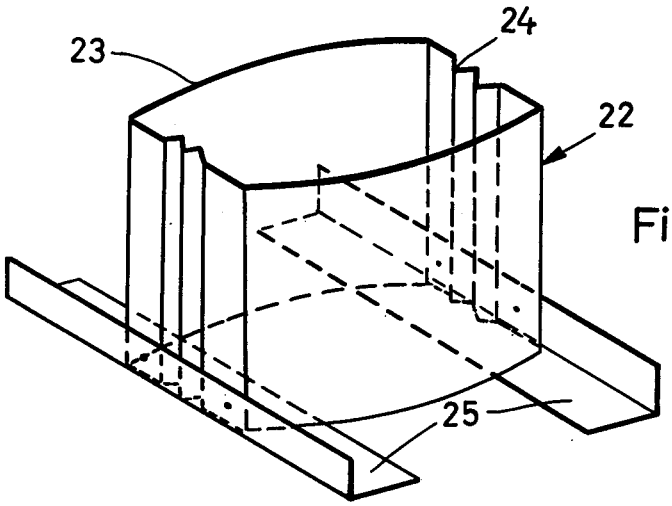

The invention will be described further, by way of example, with reference to the accompanying drawings, in which:

FIG. 1 is a rear elevational view of a delineator according to the invention with a continuous support, FIG. 2 is a rear elevational view of a delineator inserted in a foot and having the rubber sheets extend down into the foot, FIG. 3 is a rear elevational view of a delineator substantially as shown in FIG. 2, modified to have a partly discontinuous support in the middle, FIG. 4 is a rear elevational view of a delineator having a fully interrupted support, FIG. 5 is a rear elevational view of a delineator having a support made from two rubber strips, FIG. 6 is a rear elevational view of a laterally bent delineator according to FIG. 4 provided with rubber discs which are clamped at either end of the interruption in the support, FIG. 7 is a cross sectional view of a delineator as shown in FIG. 6, taken above a rubber disc, FIG. 8 is a rear elevational view of a delineator having a support structure of foam material, FIG. 9 is a cross sectional view of the delineator according to FIG. 8, taken along line X—X in FIG. 8, FIG. 10 is a cross sectional view of a delineator similar to the one shown in FIGS. 8 and 9, having the foam material support extend beyond the front edges of the rubber sheets, FIG. 11 is a diagrammatic elevational view of a delineator comprising two rubber sheets between which a hairpin support is clamped, FIG. 12 is a perspective view of a delineator similar to FIG. 11 but with a profile rod clamped between the rubber sheets, FIG. 13 is a perspective view of a foot for the delineator of FIG. 12.

The delineator according to the present invention is composed of a support structure 1 and two rubber sheets 2 made from an old tire upon remvoval of the sidewalls thereof and cutting the slightly crowned tire ring thus obtained in transverse direction to produce at least two rubber sheets 2 if the old tire was of normal size. These rubber sheets 2 are secured by rivets or the like to the legs 3 and 4 of a support 5 which forms the support structure 1 and which has the shape of an open trapezium as seen in cross section. The rubber sheets 2 face the legs of support 5 with their profile side and project upwardly beyond the same, being inclined in conventional manner. They abut each other in V-shape because of the configuration of the support. The outer side of the rubber sheets is painted white with the usual black transverse field in which reflecting elements are fastened, in agreement with the respective guidelines for street and road marking and delineators.

In the embodiment shown in FIG. 1 support 5 extends so far beyond the lower end of rubber sheets 2 that it constitutes a foot by which the delineator can be driven directly into the ground. To facilitate this work a kind of lug 20 is formed at the backside to serve as beating face for the hammer.

With the embodiments shown in FIGS. 2 to 5 the support 5 and the rubber sheets 2 end at the same lower level, i.e. the rubber sheets 2 embrace the lower fastening end 6 of the delineator, as may be seen in FIG. 3. This end 6 may likewise be planted directly into ground, or it may be inserted into a concrete foot 7, as illustrated in FIG. 2.

In a preferred embodiment of the delineator made from old tires a rated bend point 8 is provided above fastening end 6 to allow the delineator to be run over without being completely destroyed and without causing substantial damage at the vehicle. In the embodiment shown in FIG. 4 this is realized by a complete interruption of support 5. This interruption may extend over a height of 5 cm. Such a delineator may be readily run over and then bend over (see FIG. 6), without being torn out of its anchoring or fixing, and without showing any more noticeable traces than scratches or traces of paint after it has erected itself once more into the upright position. However, with this embodiment it is possible that the upper part will lean over slightly under storm or snow load. This is entirely prevented with the embodiment according to FIG. 3 which shows the support 5, likewise being of open trapezium cross sectional shape, interrupted only partly at 9 in the area of the central web or edge, whereas the two legs 3 and 4 are continuous. Also this interruption 9, which may also be effected by several larger bores, provides such weakening of the delineator that it will bend readily at the level of the interruption 9 and thus above the fastening end 6 upon impact by a vehicle. It does not erect itself automatically into the original upright position. Yet this is easy to be done by hand unless the support should be of too solid structure. This delineator will not bend under storm or snow loads nor will it become so heavily damaged by collision that it will have to be replaced by a new one in the majority of cases.

FIG. 5 shows a delineator having a support structure which consists of two supports 10, 11 in the form of rubber strips of different width, with inclined lateral edges. The rubber sheets 2 are firmly connected to the two supports. This embodiment does not require an interruption to form a rated bend point. Its inherent rigidity is greater than that of the delineators specified above.

FIG. 6 illustrates a bend delineator similar to the embodiment according to FIG. 4. As will be seen, the bending occurred at a rated bend point 8 where the support structure is discontinuous. In the case of the embodiment shown in FIG. 6 the interruption is limited at either end by a rubber disc 17 which is clamped into the inner profile side of the delineator. As will be seen from FIG. 7, the rubber disc 17 for the delineator is an approximately triangular body. When using a trapezoid support 5, as described, the triangular rubber disc is joined to the support structure by having its tip engage in an opening at the end of support 5, while the other ends engage in respective recesses of support 5 so that, in general, a displacement or slipping need not be anticipated, not even after bending of the delineator. The rubber sheets 2 which determine the outer configuration of the delineator are rendered stiffer by the rubber disc 17 in the area of the rated bend point. Consequently the outer rubber sheets are urged back into their normal position so that the bent delineator will not only return relatively quickly into upright position but also adopt its original shape once more at least to a great extent. The delineator need not be bent back manually. To enhance this effect it is convenient to shape rubber disc 17 so that it will correspond exactly to the free cross sectional outline and to connect it as firmly as possible with the rubber sheets 2. As a result, rubber disc 17 will be clamped in transverse profile direction. The connection may also be effected by screws.

A third embodiment of a suitable support structure 1 for the delineator according to the invention is shown in FIGS. 8 to 10. The support structure 1 is made from a foam support 16 intimately connected to the rubber sheets 2 by introduction of the foam directly into the space between the two rubber sheets 2 placed in a mold. Also with this design it is convenient to place a rubber disc 17 at either end of an interruption 9 in the area of the rated bend point. On the one hand, this will warrant that the body of foam material cannot be damaged easily in this area and, on the other hand, it will guarantee the return of a bent delineator into its original shape. The foam body may extend to the front edges of the two rubber sheets 2 (see FIG. 9), or it may extend beyond the same (see FIG. 10) so that the delineator will have the customary outline, in other words rounded edges all around. The foam body will be formed with a smooth outer skin and it is convenient to cover the entire delineator with a plastics hose, in particular a shrinkage hose, to which the required paint will be applied.

FIG. 11 shows a delineator which is particularly adapted to be bent easily in its upper portion and is especially useful in connection with guard rails. It comprises two somewhat larger rubber sheets 12 made from old tires and clamping between them a hairpin support 13. The two used rubber sheets are riveted together with their tread surfaces facing each other.

In a similar advantageous embodiment, see FIG. 12, between the two rubber sheets 12 is clamped a profile-rod or pin having a diameter of for instance 0,5 to 1 inch, which extends with its lower end as far as the lower ends of the rubber sheets 12 with which the delineator is adapted to be anchored in the ground or in a foot 22, see FIG. 13. The foot 22 is inserted in the ground. The foot 22 is such that its upper end terminates at a point spaced from the top of the rubber sheets 12. The two rubber sheets 12 are glued together along the edges. A hollow receiving member 23 of the foot 22 for the delineator can be provided which can be made from metal, plastic or concrete. If the receiving member 23 has a thin wall or is to be used in soft soil L-shaped or similar bars 25 will be secured to its lower end. Along the narrow walls of the receiving member 23 elongated ribs or corrugations 24 entending internally are provided which receive tight fit the lower end of the road delineator or marker at its side edges which are cut exactly to the predetermined width of the marker. As the thickness of the marker varies with the thickness of the tread portions of the tire used for its making the depth of the receiving element must be sufficient large to allow for the inevitable variations.

What is claimed is:

1. A street delineator comprising a pair of generally oppositely arranged, elongated rubber sheets which are connected to a support structure adapted to be anchored to the ground, said sheets comprising tread surface portions of used automobile tires from which the sidewalls have been removed, said support structure disposed between said sheets and including an upright reinforcing portion extending upwardly along said sheets from the lower ends thereof and in reinforcing contact therewith, said reinforcing portion of the support portion being approximately V-shaped in cross-section to define a V-shaped support portion, the two rubber sheets being fixed to legs of said V-shaped support portion so as to be disposed at an angle relative to each other, said support structure being completely interrupted above the lower end of the delineator at a location intermediate the ends of the sheets to define at least one rated bend point so that the delineator is continuously urged upright by the rubber sheets.

2. A delineator according to claim 1, characterized in that the rubber sheets are fixed such that the tread surfaces of the automobile tires face the support structure.

3. A delineator according to claim 1, characterized in that the rubber sheets extend as far as the lower end of the delineator.

4. A delineator according to claim 1, wherein said support structure includes a rubber disc filling the cross sectional area is fixed at either end of the rated bend point of the support structure.

* * * * *